US008469861B1

(12) United States Patent
McFee et al.

(10) Patent No.: US 8,469,861 B1
(45) Date of Patent: Jun. 25, 2013

(54) PUSHABLE EXERCISE APPARATUS FOR RESISTANCE TRAINING

(75) Inventors: Susan L. McFee, Kansas City, MO (US); Rodney L. Wickwar, Overland Park, KS (US); Jim Connolly, Kansas City, MO (US)

(73) Assignee: Susan L. McFee, Kansas City, MO (US)

( * ) Notice: Subject to any disclaimer, the term of this patent is extended or adjusted under 35 U.S.C. 154(b) by 1021 days.

(21) Appl. No.: 12/499,568

(22) Filed: Jul. 8, 2009

Related U.S. Application Data

(60) Provisional application No. 61/090,440, filed on Aug. 20, 2008.

(51) Int. Cl.
*A63B 71/00* (2006.01)
*A63B 24/00* (2006.01)
*A63B 21/005* (2006.01)

(52) U.S. Cl.
USPC ..... 482/5; 482/4; 482/74

(58) Field of Classification Search
USPC ..... 482/1, 2, 4, 5, 6, 8, 51, 66, 68, 74, 482/78, 92, 114, 115, 903
See application file for complete search history.

(56) References Cited

U.S. PATENT DOCUMENTS 3,062,548 A 11/1962 Foster et al.
3,237,940 A 3/1966 Johsnon
4,334,677 A * 6/1982 Tata ..... 482/14
4,451,037 A 5/1984 O'Hare
4,495,813 A 1/1985 Lojko et al.
4,813,664 A 3/1989 Vroulis
4,867,439 A 9/1989 Salyer
4,907,794 A 3/1990 Rose
5,197,931 A 3/1993 Wroclawsky
5,267,925 A * 12/1993 Boyd ..... 482/64
5,674,165 A 10/1997 Cohen et al.
5,810,697 A 9/1998 Joiner
5,876,309 A 3/1999 Archey
6,086,517 A 7/2000 Schapmire
6,196,947 B1 3/2001 Anderson
6,561,537 B1 5/2003 Chen
6,612,971 B1 9/2003 Morris
6,749,543 B2 6/2004 McLaughlin
6,942,585 B1 9/2005 Krause
7,001,313 B1 2/2006 Crnkovich
7,025,710 B2 4/2006 Corbalis et al.

(Continued)

OTHER PUBLICATIONS

"Featured Products". Werelectrified. Posted Date: Unknown; Printed Date: Oct. 11, 2009; <http://www.werelectrified.com/>.

(Continued)

*Primary Examiner* — Oren Ginsberg
*Assistant Examiner* — Sundhara Ganesan
(74) *Attorney, Agent, or Firm* — Hovey Williams LLP

(57) ABSTRACT

A pushable exercise apparatus configured to be pushed along a surface by a user and to provide user-selected variation in resistance to rotation applied to wheels of the apparatus. The apparatus may comprise a frame, a handle, a wheel shaft rotatably supported by the frame, one or more wheels fixedly attached to the wheel shaft, and an electrical braking system, such as a generator braking system. The electrical braking system may have a motor driven by rotation of the wheel shaft and variable electrical resistance such that an amount of torque and/or effort required to rotate at least one of the wheels is dependant on the amount of electrical resistance provided to the motor.

17 Claims, 6 Drawing Sheets

U.S. PATENT DOCUMENTS

| | | | | |
|---|---|---|---|---|
| 7,104,929 | B1 | 9/2006 | Eschenbach | |
| 7,156,780 | B1 * | 1/2007 | Fuchs et al. | 482/92 |
| 7,678,026 | B2 * | 3/2010 | Lewis | 482/74 |
| 2002/0086780 | A1 * | 7/2002 | Morris | 482/136 |
| 2003/0073546 | A1 * | 4/2003 | Lassanske et al. | 482/63 |
| 2003/0228959 | A1 | 12/2003 | Perlstein | |
| 2005/0164850 | A1 | 7/2005 | Leibowitz | |
| 2005/0272572 | A1 | 12/2005 | Lewis | |
| 2007/0057483 | A1 * | 3/2007 | Barak et al. | 280/288.4 |
| 2008/0227604 | A1 * | 9/2008 | Daniel | 482/74 |
| 2009/0138488 | A1 | 5/2009 | Shea | |

OTHER PUBLICATIONS

"Crystalyte Parts". ElectricRider. Posted Date: Unknown; Printed Date: Oct. 11, 2009; <http://www.electricrider.com/crystalyte/parts.htm>.

* cited by examiner

PUSHABLE EXERCISE APPARATUS FOR RESISTANCE TRAINING

RELATED APPLICATIONS

This nonprovisional patent application claims priority benefit, with regard to all common subject matter, of earlier-filed U.S. provisional patent application titled "Resistance Trainer Exercise Device", Ser. No. 61/090,440, filed Aug. 20, 2008, hereby incorporated by reference in its entirety into the present application.

BACKGROUND

1. Field

Embodiments of the present invention relate to resistance training. More particularly, embodiments of the present invention relate to a pushable exercise apparatus with wheels and user-selected variation in torque required to urge the wheels along a surface.

2. Related Art

Various resistance devices or resistance-providing carts exist that allow a user to walk or run while pushing the resistance device. These resistance devices provide various methods to impose load or resistance to increase the torque required to push or pull the resistance device. For example, some resistance devices provide an increase in weight applied onto the device in order to increase resistance. However, applying additional weight to the device requires a user to stop walking or running in order to change the amount of resistance or weight. Additionally, the resistance provided by the weight in these resistance devices can vary by an undesired or even dangerous amount depending on if the user is going uphill or downhill and the amount of slope in the terrain.

SUMMARY

Embodiments of the present invention solve the above-mentioned problems and provide a distinct advance in the art of pushable resistance training devices. More particularly, embodiments of the invention provide a pushable apparatus operable to roll along a surface and provide resistance to a user. In preferred embodiments of the invention, the apparatus provides resistance via an electrical braking system, such as a generator braking system.

The pushable apparatus may comprise a frame, a handle, at least one wheel, a wheel shaft fixedly attached to the wheel and rotatably supported by the frame, and the electrical braking system having a motor driven by the rotation of the wheel shaft and comprising variable electric resistance. For example, a variable resistor may provide varying amounts of electrical resistance to the motor such that an amount of torque required to rotate the wheel when the electrical resistance is small is greater than the amount of torque required to rotate the wheel when the electrical resistance is large.

The pushable apparatus may further comprise any number of wheels, which may or may not be fixedly attached to the wheel shaft for additional balance and stability of the pushable apparatus. Furthermore, the frame may comprise or be coupled with a user control panel operable to change the amount of electrical resistance provided to the electrical braking system, thereby changing the amount of torque or effort required by a user to push the apparatus in a forward direction. The wheel shaft may additionally comprise or be coupled with uni-directional clutch bearings such that the motor is driven only when the pushable apparatus is being pushed forward and the wheel shaft disengages from the electrical braking system when the pushable apparatus is pulled backwards, thereby allowing the wheels to freely rotate.

The control panel may comprise a user interface, a processor, and/or various sensors. The user interface may allow a user to set various amounts of resistance to be provided, such as at various timing or location intervals, and may comprise user outputs such as a display to display information regarding the apparatus, the user, and/or a particular exercise routine. The processor may additionally or alternatively automatically change the resistance based on pre-programmed data and/or data received from the sensors.

This summary is provided to introduce a selection of concepts in a simplified form that are further described below in the detailed description. This summary is not intended to identify key features or essential features of the claimed subject matter, nor is it intended to be used to limit the scope of the claimed subject matter.

Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
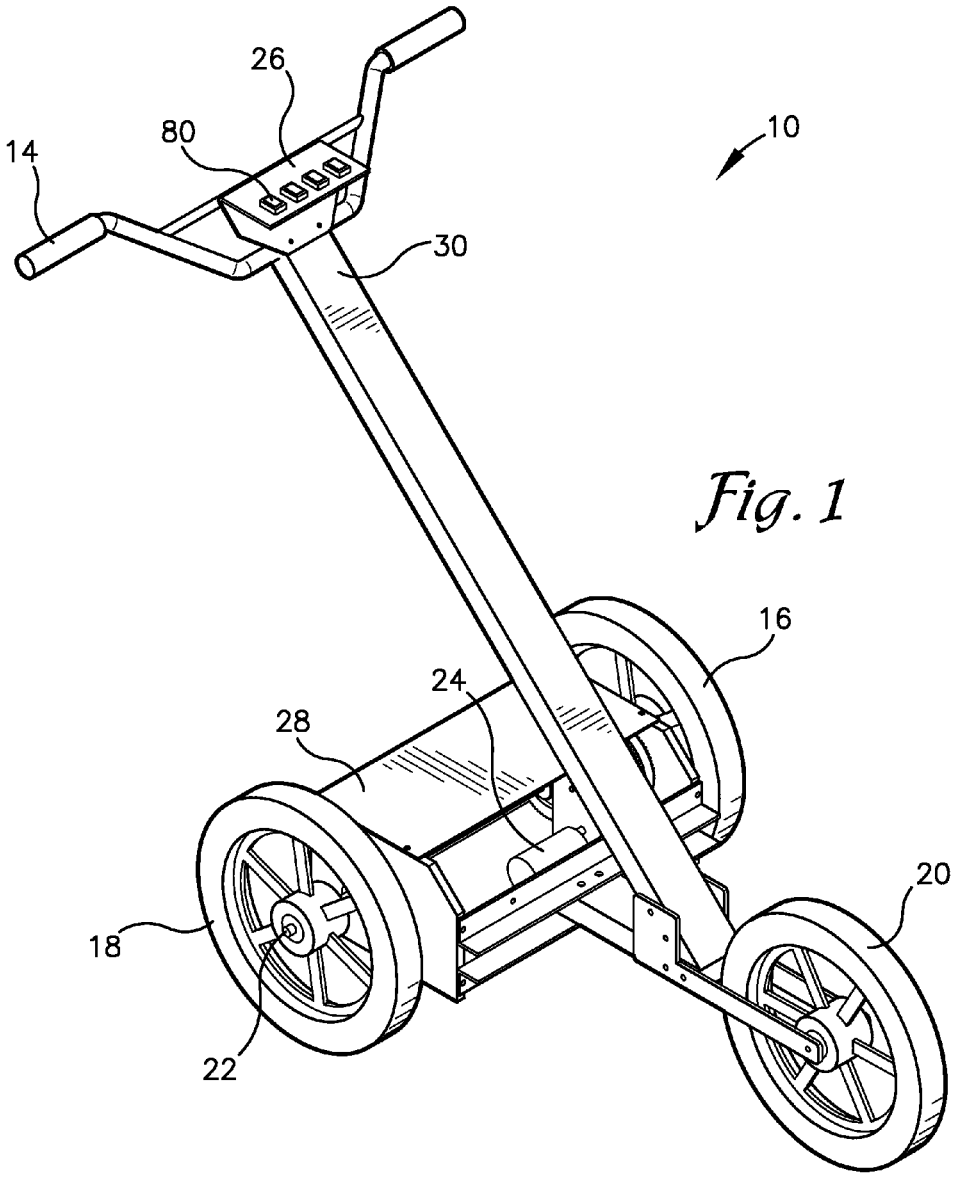
FIG. 1 is a perspective view of a pushable exercise apparatus constructed in accordance with an embodiment of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 2:
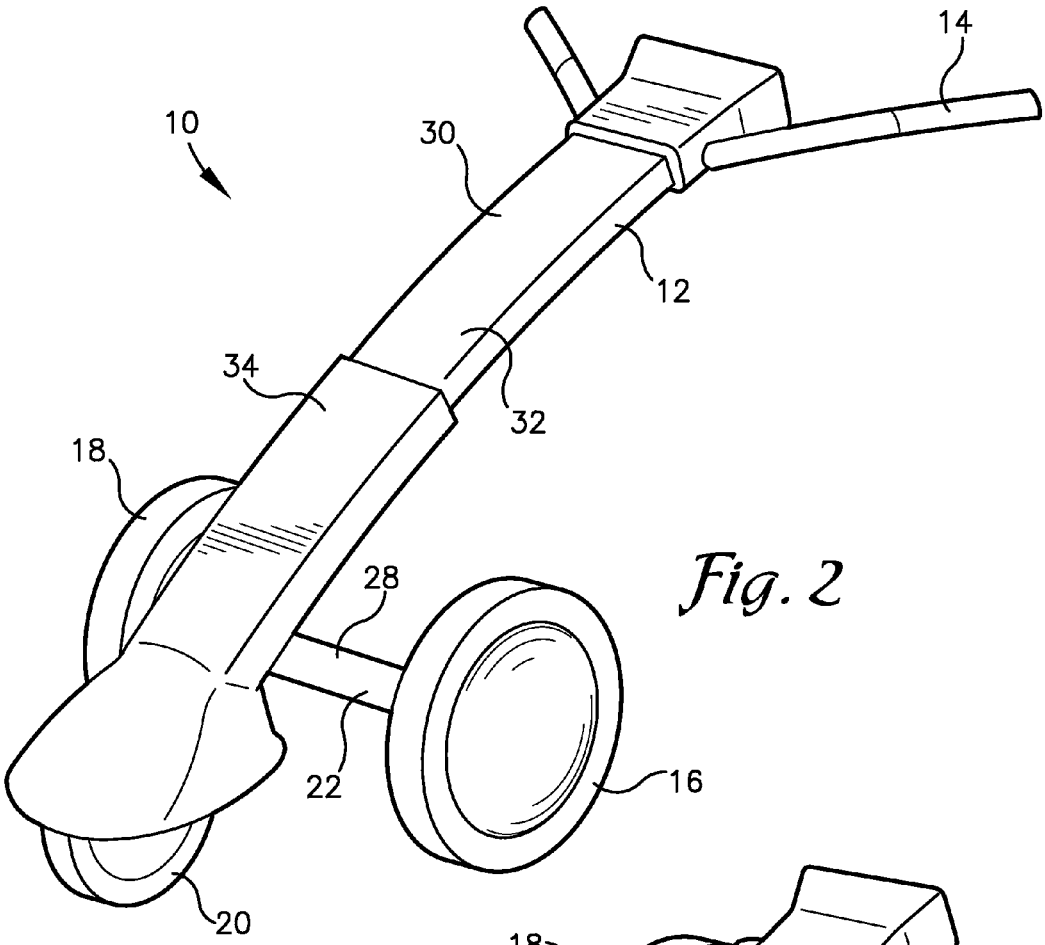
FIG. 2 is a perspective view of another embodiment of the pushable exercise apparatus of FIG. 1.

FIGS. 1 and 2 illustrate embodiments of a pushable exercise apparatus 10 configured for providing varying amounts of resistance to a user pushing the apparatus 10. For example, a user may push the pushable exercise apparatus 10 along any surface such as a road, sidewalk, track, or trail, while walking, running, jogging, skipping, or otherwise moving forward. The apparatus 10 may comprise a frame 12, a handle 14, one or more wheels 16, 18, 20, a wheel shaft 22, an electrical braking system 24, and a control panel 26.

Figure 3:
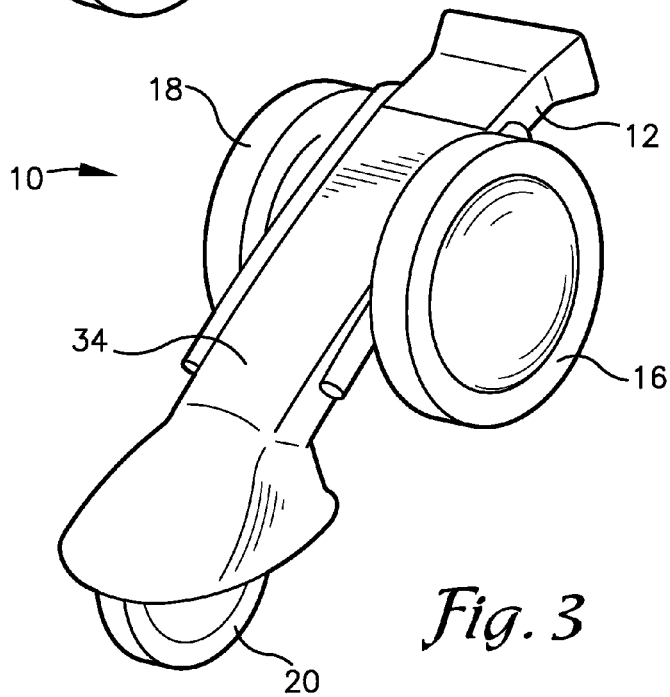
FIG. 3 is a perspective view of the pushable exercise apparatus of FIG. 2 placed in a stowed configuration.
Figure 4:
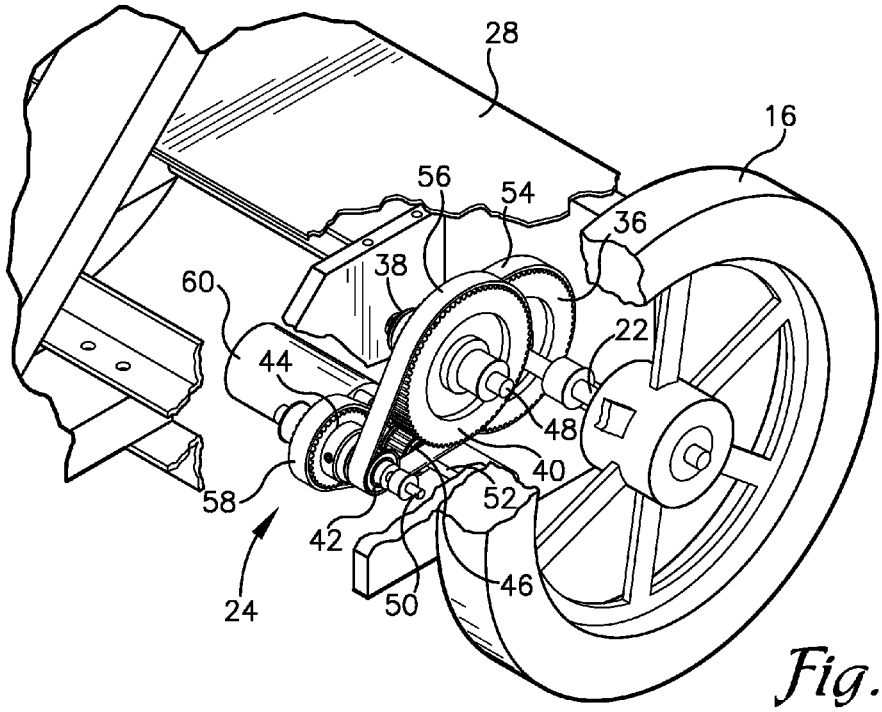
FIG. 4 is a fragmentary perspective view illustrating a braking system of the pushable exercise apparatus of FIG. 1.
Figure 5:
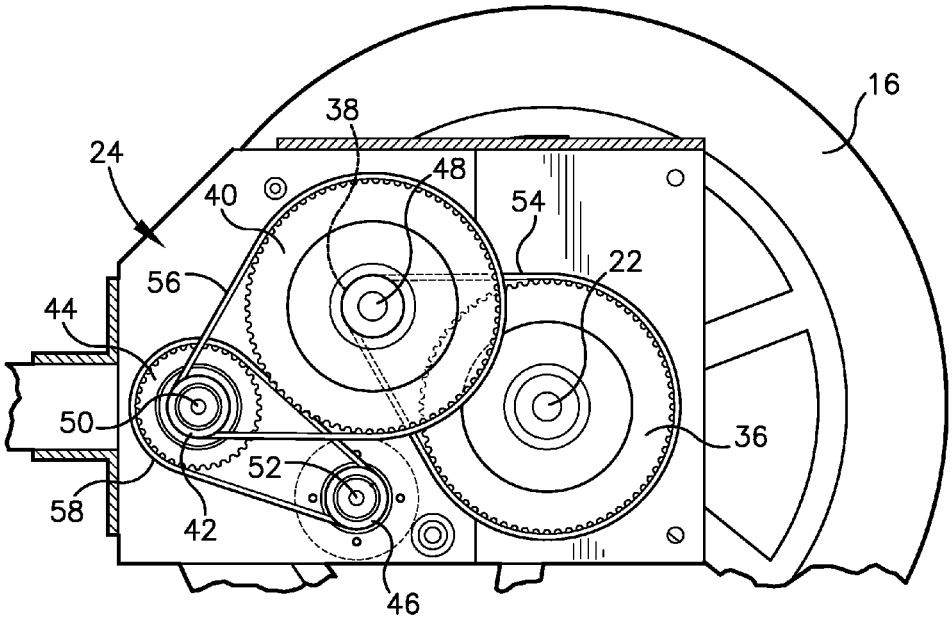
FIG. 5 is a fragmentary, cross-sectional side view of the braking system of FIG. 4.

The frame 12, illustrated in FIGS. 1-3, may be composed of one or more pieces of plastic, metal, or any substantially rigid substance and may comprise a lower portion 28 and an upper portion 30. The lower portion 28 may rotatably support the wheels 16-20, and the upper portion 30 may support the handle 14 and/or the control panel 26. The lower portion 28 may be suspended a small distance from a surface such as the ground by one or more of the wheels 16-20. The upper portion 30 may extend upward from the lower portion 28 to a reasonable height for a user to grab onto the handle 14. For example, the upper portion 30 may extend from the lower portion 28 to a height of approximately 1 ft. to 6 ft. from the ground. The frame 12 may further comprise one or more hooks, containers, equivalents and the like for holding water bottles or personal items.

The lower portion 28 may be slidably and/or pivotally connected with the upper portion 30 of the frame 12 for purposes of storing the apparatus 10, as illustrated in FIGS. 2 and 3. However, the lower portion 28 may alternatively be integral with the upper portion 30. In addition to supporting the wheels 16-20, the lower portion 28 may also fixedly and/or rotatably support portions of the electrical braking system 24, as later described herein.

The upper portion 30 may be elongated in a substantially vertical or angled orientation relative to the lower portion 28. The upper portion 30 may comprise one or more sections 32,34, as illustrated in FIGS. 2-3, which may be slidably and/or pivotally attached with each other such that the frame 12 may be configured in a first position for storage and reconfigured in a second position for operation. In one example, for ease of storage and/or to vary a height of the handle 14, a first section 32 may telescope within or be slidable into a second section 34 and slidable out from the second section 34. When the upper portion 30 is set to a desired extended position and/or a stowed position, a stop or locking mechanism (not shown) may prevent the first section 32 from sliding relative to the second section 34. Alternatively, the first section 32 may be pivotally attached to the second section 34 so that the two sections may be folded together in a stowed position or folded away from each other in an extended position for operation and use.

The handle 14 affixed on the upper portion 30 of the frame 12 may comprise any of one or more handles, handlebars, rods, or other apparatus operable to be grasped by or attached to a user, as illustrated in FIGS. 1-3. For example, when the user grips the handle 14 and begins walking forward, the apparatus 10 will also roll forward. The handle 14 may be composed of metal, plastic, rubber, composites, or any other substantially durable material. In one embodiment, the handle 14 may be similar to stroller handles or bicycle handles. The handle 14 may be selectively adjustable, rotatable, and/or pivotal relative to the frame 12 to provide a comfortable level and angle for the user. In some embodiments of the invention, the handle 14 may be removable, foldable, pivotal, or slidable relative to the frame 12 when the apparatus 10 is placed in a stowed configuration, as in FIG. 3.

The one or more wheels 16-20 may comprise any combination of a first wheel 16, a second wheel 18, and/or a third wheel 20. However, more or fewer wheels may be used without departing from the scope of the invention. For example, the apparatus 10 may be a one-wheel cart, a two-wheel cart, a three-wheel cart, or a four-wheel cart. In one embodiment of the invention, a spare wheel (not shown) may be added for individuals needing more support and removed for users who do not need the added support. The wheels 16-20 may comprise rubber, plastic, metal, composites, or any substantially rigid material such that the wheels 16-18 are operable to rotate when urged forward along a surface. The wheels 16-18 may include substantially circular discs, spoked wheels, tires, cylindrical wheels, spherical wheels, or any other type of wheel known in the art operable to rotate 360 degrees. Any one or more of the wheels 16-20 may drive the electrical braking system 24 later described herein.

The first wheel 16 and/or the second wheel 18 may be rotatable relative to the frame 12 and may be fixedly attached to the wheel shaft 22. For example, the first and second wheels 16,18 may be fixedly attached at opposite ends of the shaft 22. The third wheel 20 may be positioned forward of and centered relative to the first and second wheels 16,18 and may be rotatably connected to the frame 12 using any method known in the art. For example, the first, second, and third wheels 16-20 may be positioned in a substantially triangular configuration with each other. In one embodiment of the invention, the third wheel 20 and/or a portion of the frame 12 may be steerable such that when the handle 14 is turned in a particular direction, the third wheel 20 is also angled in that direction.

The wheel shaft 22 may be composed of metal, plastic, composite, or any other substantially rigid material and may be an elongated cylindrical component fixed relative to one or more of the wheels 16-20 and rotatable relative to the frame 12. For example, the first and second wheels 16 and 18 may be positioned outward of the lower portion 28 of the frame 12, and the wheel shaft 22 may extend through the lower portion 28 of the frame 12. The wheel shaft 22 may also be fixedly attached to at least one component of the electrical braking system 24, as described below. Additionally or alternatively, the wheel shaft 22 may comprise uni-directional clutch bearings (not shown) such that when the wheel shaft 22 is rotating forward (i.e., the apparatus 10 is being pushed forward), the clutch bearings are engaged with the electrical braking system 24, but when the apparatus 10 is being pulled and/or the wheel shaft 22 is rotating backwards, the clutch bearings are disengaged from the electrical braking system 24, such that the electrical braking system 24 does not provide resistance to the apparatus 10 when it is pulled backwards.

As illustrated in FIGS. 4-7, the electrical braking system 24 may be a generator braking system and may comprise a plurality of gears 36, 38, 40, 42, 44, 46, a plurality of shafts 48, 50, 52, a plurality of belts 54, 56, 58, and/or a motor 60. The motor 60 may be driven by the rotation of motor drive shaft 52 and may comprise a variable resistor 62 or an equivalent apparatus for providing variable electrical resistance to the motor.

In embodiments of the invention where the electrical braking system 24 is a generator braking system, the motor 60 (or generator) of the electrical braking system 24 may be operable to propel the apparatus 10 and/or to stop the apparatus 10. By pulling power from the motor 60, such as through the variable resistor 62 illustrated in FIG. 7, a physical resistance to motion is created, causing a rotor or the motor drive shaft 52 to slow down the apparatus and to generate electricity. The generator braking system may be considered "frictionless" as the resistance is generated from an electromagnetic field. An advantage of using the generator braking system is an elimination of wear components and an ability to vary the electrical load or resistance, thereby increasing drag or resistance.

The gears 36-46 of the electrical braking system 24 may be rotatably connected with each other to transfer the rotation of one or more of the wheels 16-20 to the motor 60. Additionally, the gears 36-46 may be of differing sizes such that ratios of cooperatively rotating gears cause the motor 60 to rotate a plurality of times per each single rotation of the wheels 16-20 or the wheel shaft 22. For example, for each rotation of wheel 16, the motor drive shaft 52 may rotate the motor 60 approximately 100 to 300 times. In one embodiment of the invention, for each rotation of wheel 16, the motor drive shaft 52 may rotate the motor 60 at or about 200 times.

Each of the gears 36-46 may be any substantially circular gears and/or sprockets and may comprise teeth, protrusions, and/or indentations about a circumference thereof, which may either couple with teeth, protrusions, and/or indentations of an adjacent gear or substantially grip a corresponding belt 54-58 to rotatably couple two or more of the gears 36-46. In one embodiment of the invention, the wheel shaft 22 may be fixedly attached to a first gear 36. The first gear 36 may be rotatably coupled with a second gear 38. The second gear 38 may be fixedly attached through its rotational axis to a first intermediate shaft 48, and the first intermediate shaft 48 may also be fixedly attached to a third gear 40, such that rotation of the second gear 38 causes both the first intermediate shaft 48 and the third gear 40 to rotate. The third gear 40 may be rotatably coupled with a fourth gear 42, which may be fixedly attached through its rotational axis to a second intermediate shaft 50, and the second intermediate shaft 48 may also be fixedly attached to a fifth gear 44. Thus, when the third gear 40 rotates, it may cause the fourth gear 42, the second intermediate shaft 50, and the fifth gear 44 to rotate. The fifth gear 44 may be rotatably coupled with the sixth gear 46, and the sixth gear 46 may be fixedly attached to the motor drive shaft 52. Thus, the fifth gear 44 may cause the sixth gear 46, the motor drive shaft 52, and the motor 60 to rotate.

The shafts 48-52 may be comprised of metal, plastic, wood, composites, or any substantially rigid substance and may be rotatably connected to the frame 12 and fixedly attached to the gears 36-46 as described above. The belts 54-58 may each be comprised of rubber or another suitably malleable substance and may be positioned along at least a portion of circumferences of two or more of the gears 36-46. The tension and coefficient of friction between the gears 36-46 and the belts 54-58 may be such that the rotation of the gears 36-46 causes the belts 54-58 to be urged in a direction of rotation of the gears 36-46. For example, a first belt 54 may be placed around and rotatably couple the first and second gears 36,38; a second belt 56 may be placed around and rotatably couple the third and fourth gears 40,42; and a third belt 58 may be placed around and rotatably couple the fifth and sixth gears 44,46.

Figure 6:
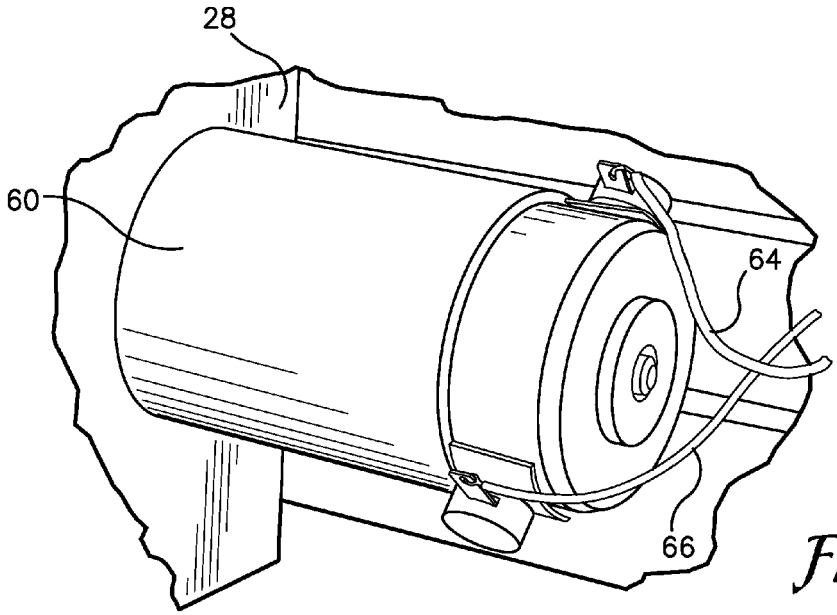
FIG. 6 is a fragmentary perspective view illustrating the motor of the braking system of FIG. 4.
Figure 7:
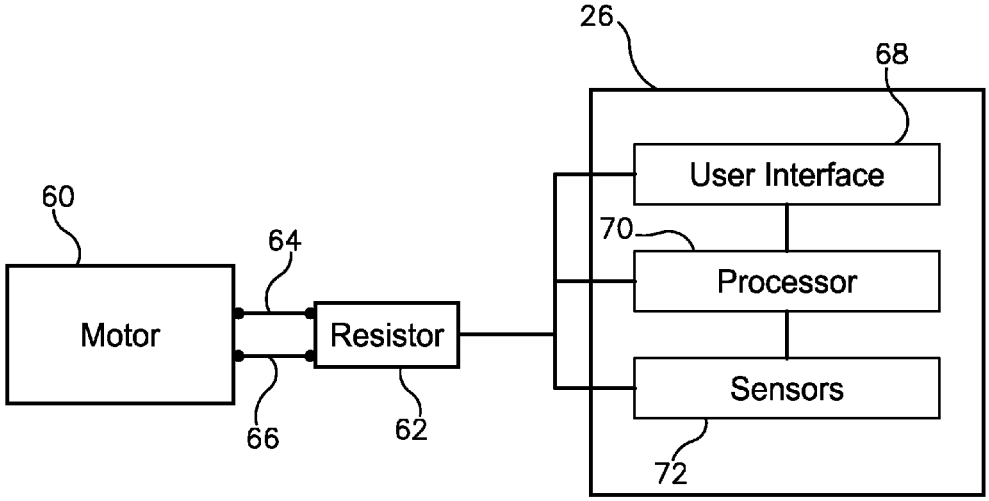
FIG. 7 is a block diagram of various electrical components of the pushable exercise apparatus of FIG. 1.
Figure 8:
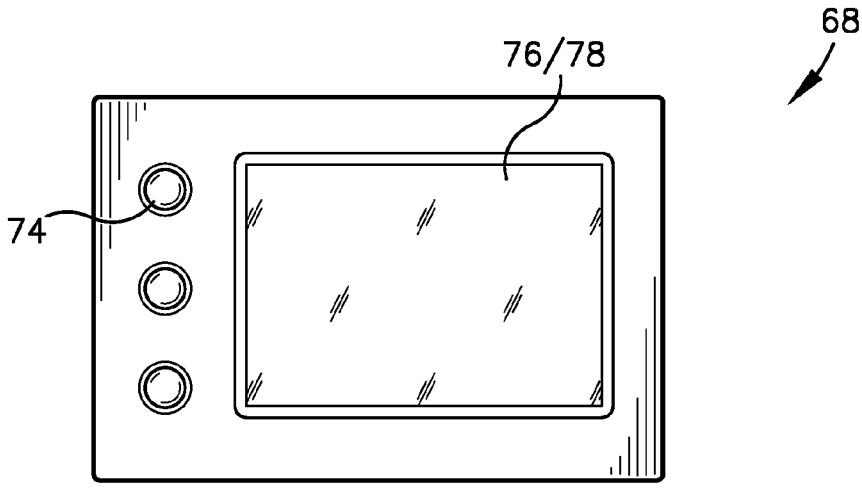
FIG. 8 is a top plan view illustrating an embodiment of a user interface of the pushable apparatus of FIG. 1.
Figure 9:
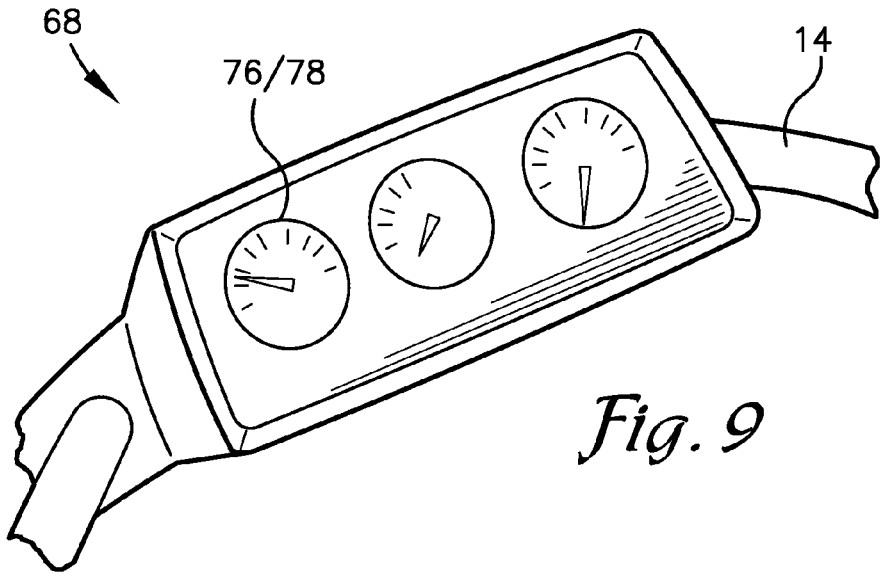
FIG. 9 is a fragmentary perspective view illustrating another embodiment of the user interface of FIG. 8.

The motor 60 may be any generator or alternator known in the art which develops electrical current by mechanical rotation of its rotor via the motor drive shaft 52, and may comprise two or more electrical leads 64,66, as illustrated in FIGS. 6-7. The generated electrical current may be provided to electrical systems or devices attached to or integral with the apparatus 10, stored in a battery, and/or dissipated as heat from a resistor using a heat sink. For example, the apparatus may comprise an electrically powered drink cooler (not shown) which may be powered by the motor 60. Additionally, various sensors and processors described below may be powered by the motor 60, which is driven by the motion of the wheels 16-20. However, in some embodiments of the invention, the electricity and/or heat is not intentionally output to any other device and is simply a byproduct of creating a desired resistance.

The variable resistor 62 may be any apparatus for drawing a variable amount of electric current from the motor, thereby creating varying amounts of resistance and varying amounts of torque or effort required to push the apparatus 10 forward. For example, the variable resistor 62 may comprise a plurality of resistors (not shown) that may be connected or disconnected to the motor 60 through one or more switches. The variable resistor 62 may be electrically coupled to the motor 60 via the electrical leads 64,66. The variable resistor 62 may be configured to provide anywhere from a full resistance load to no resistance load (i.e., the variable resistor 62 may be sorted). In some embodiments of the invention, the variable resistor may be located within and/or directly accessible to a user through the control panel 26.

Illustrated in FIGS. 1 and 7-9, the control panel 26 may be positioned at or proximate to the upper portion 30 of the frame 12 and/or the handle 14, or any location accessible to a user of the apparatus 10. The control panel 26 may be physically, communicably, and/or electrically connected to the variable resistor 62 and may be configured to control the amount of electrical resistance provided by the variable resistor 62. The control panel 26 may also comprise and/or be communicably coupled with a user interface 68, a processor 70, and/or one or more sensors 72.

The user interface 68 may comprise one or more user inputs 74 and/or one or more user outputs 76. The user inputs 74 may permit a user to change the resistance of the apparatus 10, program timing intervals and associated amounts of resistance to be used during particular timing intervals, and/or enable users, third parties, or other devices to share information with the apparatus 10. The user inputs 74, for example, may comprise one or more functionable inputs such as switches 80 (as in FIG. 1), knobs, dials, buttons, scroll wheels, a touch screen, voice recognition elements such as a microphone, pointing devices such as mice, touchpads, tracking balls, or styluses, a camera such as a digital or film still or video camera, and combinations thereof.

The user inputs 74 may comprise wired or wireless data transfer elements such as a removable memory or data transceivers, to enable the user and other devices or parties to remotely interface with the apparatus 10. The user inputs 74 may also comprise or be communicably coupled with one or more of the sensors 72 described below. In one example, the user inputs 74 may include a TransFlash card slot for receiving removable TransFlash cards and a USB port for coupling with a USB cable connected to another computing device such as a personal computer. Additionally or alternatively, the user inputs 74 may comprise a wireless receiver, dock, and/or connection port configured for communicably coupling with a portable electronic device such as an iPod™, iPhone™, or any mobile phone. The electronic device may comprise software and/or applications configured to interface with and operate the apparatus 10 and to store user settings, apparatus configurations, and/or recorded statistics related to the user.

The user outputs 76 may comprise gauges and/or a display 78 that may display information regarding a distance covered by the apparatus 10, speed of the apparatus 10, amount of resistance (e.g., high, medium, low), and an estimated/calculated amount of calories and/or body fat burned by a user. The display 78 may be coupled with the processor 70 and may display various information corresponding to operation of the apparatus 10, user input, and/or sensor input. The display 78 may comprise conventional black and white, monochrome, or color display elements including CRT, TFT, LCD, and/or plasma display devices. In various embodiments of the apparatus 10, the display 78 may be a touch-screen display to enable the user to interact with it by touching or pointing at display areas to provide information to the processor 70. In some embodiments of the invention, the user outputs 76 may additionally or alternatively comprise speakers configured for outputting audible information to the user.

The processor 70 may include any number of processors, controlling devices, integrated circuits, programmable logic devices, or other computing devices and resident or external memory (not shown) for storing data and other information accessed and/or generated by the user interface 68 or the sensors 72. The memory may include, for example, removable and non-removable memory elements such as RAM, ROM, flash, magnetic, optical, USB memory devices, and/or other conventional memory elements.

The memory may store sequences, time intervals, resistance amounts, locations, and other information related to particular workout routines that may be selected by the user or chosen automatically by the processor 70 based on various pre-programmed conditions. The memory may also store data recorded during operation of the apparatus 10 to provide real-time feedback or to be downloaded for future analysis. Further, the processor 70, the user interface 68, and the sensors 72 may be integral and/or communicably coupled, and may be combined or separate or otherwise discrete elements.

A computer program of the present invention may be stored in or on a computer-usable medium, such as a computer-readable medium, residing on or accessible by the processor 70 to implement methods of the present invention as described herein. The computer program may comprise an ordered listing of executable instructions for implementing logical functions in the processor 70 and other computing devices coupled with the processor 70. The computer program can be embodied in any computer-usable medium for use by or in connection with an instruction execution system, apparatus, or device, such as a computer-based system, processor-containing system, or other system that can fetch the instructions from the instruction execution system, apparatus, or device, and execute the instructions.

The ordered listing of executable instructions comprising the computer program of the present invention will hereinafter be referred to simply as "the program" or "the computer program." It will be understood by those skilled in the art that the program may comprise a single list of executable instructions or two or more separate lists, and may be stored on a single computer-usable medium or multiple distinct media. The program will also be described as comprising various "code segments," which may include one or more lists, or portions of lists, of executable instructions. Code segments may include overlapping lists of executable instructions, that is, a first code segment may include instruction lists A and B, and a second code segment may include instruction lists B and C.

In the context of this document, a "computer-usable medium" can be any medium that can contain, store, communicate, propagate or transport the program for use by or in connection with the instruction execution system, apparatus, or device. The computer-usable medium can be, for example, but is not limited to, an electronic, magnetic, optical, electromagnetic, infrared, or semi-conductor system, apparatus, device, or propagation medium. More specific, although not inclusive, examples of computer-usable media would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM).

The processor 70 may be configured for receiving and using information input by a user or stored in memory to determine or calculate information regarding the apparatus 10 and/or the user. For example, the processor 70 may determine estimated calories burned, distance per unit of time, amount of power generated by the apparatus 10, and/or an estimated body fat percentage. Additionally, the processor 70 may automatically determine when and by what amount the resistance provided to the wheels 16-20 should be changed based on sensor readings, pre-programmed or user-programmed timing intervals or parameters, and/or resistance routines stored in memory. The processor 70 may also be configured, equipped, and/or communicably coupled with the sensors 72 to determine an angle of incline of a surface upon which the apparatus 10 is being used and/or a speed of travel of the apparatus 10 and then to adjust an amount of resistance provided to the apparatus 10 based on the information received by the sensors. Furthermore, information regarding use of the apparatus 10 and/or the user may be recorded in memory and/or downloaded to an external device for review.

The sensors 72 may include any sensor and/or any device communicably coupled with other sensors. For example, the sensors 72 may comprise one or more of a speedometer, an odometer, a heart rate monitor, and a location-determining sensor such as a GPS receiver. The sensors 72 may allow the user to keep track of their pace, location, calories burned, distance to a goal, user biometric data, and other information. The location-determining sensor may be used by the processor 70 to display a user's location on the display 78, to keep track of a distance traveled, and/or to reset the resistance based on a particular location or distance interval being reached. In one embodiment of the invention, one or more of the sensors 72 may be configured to obtain biometric data which may be provided to the processor 70 to be recorded in memory, displayed on the display 78, and/or to determine how much resistance should be applied to the wheels 16-20 and/or motor 60 based on the biometric data.

In another embodiment of the invention, the sensors 72 may comprise and/or be communicably coupled with a remote control device such that a trainer or another observer may remotely increase or decrease the resistance of the apparatus 10. The sensors 72 may also comprise external devices configured to specify a particular order and timing sequence for changing the resistance of the apparatus and/or identifying a user such that various resistance settings and output options stored for that user may be applied to the apparatus 10. For example, the sensors 72 may comprise a radio frequency identification (RFID) reader for identifying RFID tags of individual users to facilitate rapid transition time in group use of the apparatus 10 and to accurately record results of that individual user.

In operation, a user may grasp the handle 14 and may push the apparatus 10 along a surface in a forward direction. As the user pushes the apparatus 10, the wheels 16-20 may rotate. As the wheels rotate, the motor drive shaft 52 may also rotate. The user may use the control panel 26 to change an amount of resistance provided to the apparatus 10. As the user increases the electrical resistance provided to the motor 60, the amount of torque required to rotate the wheels 16-20 and push the apparatus 10 becomes smaller. As the user decreases the electrical resistance provided to the motor 60, the amount of torque required to rotate the wheels 16-20 and push the apparatus becomes larger.

A number of methods for increasing and decreasing the resistance applied to the wheels 16-20 of the apparatus 10 may be employed, as described below. For example, simple mechanical switches 80 may be flipped by the user to change the amount of electrical resistance connected to the motor 60. However, complex software running on the processor 70 may be used to provide a variety of resistance amounts, timing sequences, location-dependent resistance changes, slope-dependent resistance changes, and other changes dependent on environmental factors. Operation of the apparatus 10 may also comprise recording various data received from the sensors 72 and displaying various data on the display 78.

Figure 10:
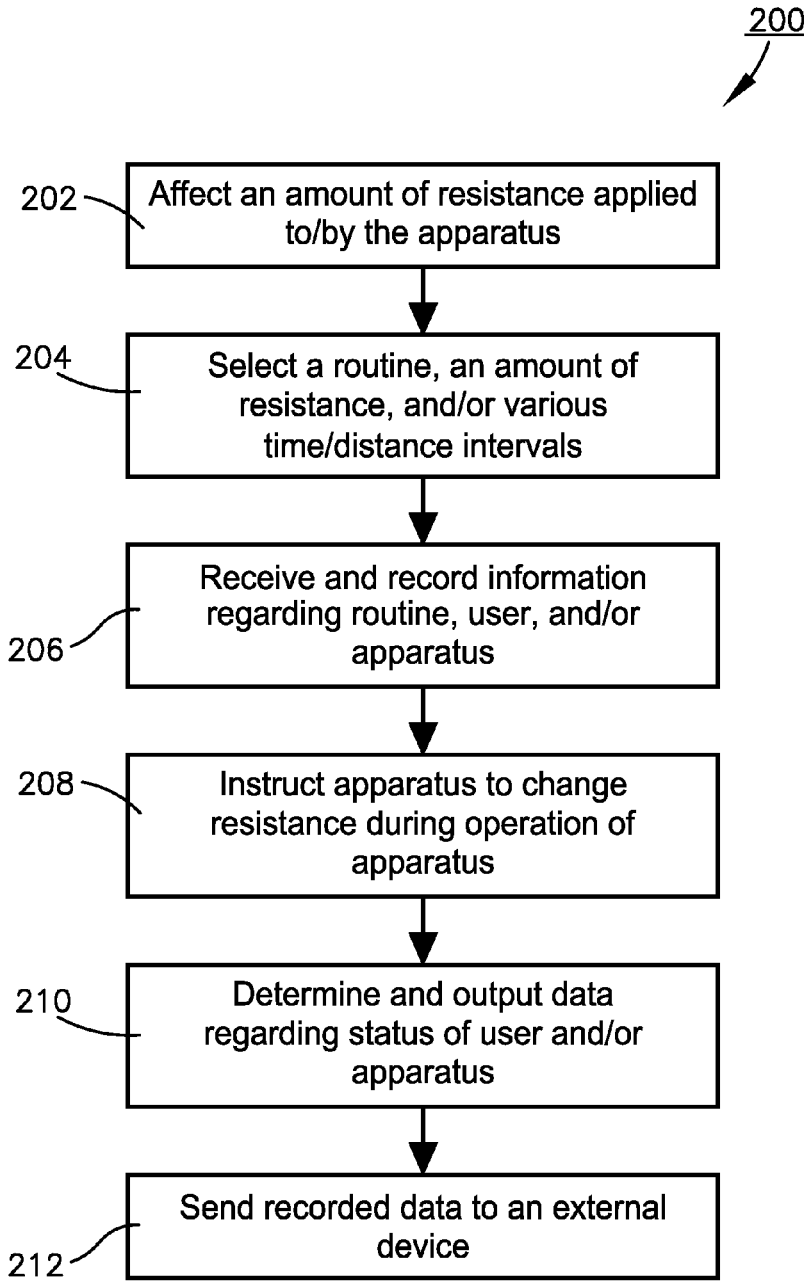
FIG. 10 is a flow chart of a method of using the apparatus of FIG. 1.

The flow chart of FIG. 10 depicts the steps of an exemplary method 200 of the invention in more detail. In this regard, some of the blocks of the flow chart may represent a module segment or portion of code of the computer programs stored in or accessible by the processor. In some alternative implementations, the functions noted in the various blocks may occur out of the order depicted in FIG. 10. For example, two blocks shown in succession in FIG. 10 may in fact be executed substantially concurrently, or the blocks may sometimes be executed in the reverse order depending upon the functionality involved.

Therefore, the method 200 of using the apparatus 10 for resistance training may comprise any combination of the following steps. The control panel 26 and/or processor 70 may be used to determine and affect an amount of resistance applied to and/or by the apparatus 10, as depicted in step 202. For example, the processor 70 may select a particular exercise routine out of one or more exercise routines stored in memory. An exercise routine may be any programmed sequence of instructions to the processor 70 for what criteria prompts a change in resistance (e.g., time, distance, or sensor readings) and what level or amount to change the resistance. Additionally or alternatively, the processor 70 may determine what routine, what resistance amounts, and/or what time/distance intervals to apply to the apparatus 10 based on signals received by various sensors 72 and/or the user interface 68, as depicted in step 204. In one embodiment of the invention, the processor 70 may obtain biometric data from the sensors 70 and may select an amount of resistance to be applied to the wheels 16-20 based on the biometric data. In some embodiments of the invention, the user may flip a switch or rotate a dial during operation of the apparatus 10 to change the resistance provided to the motor 60.

Furthermore, as depicted in step 206, the processor 70 may receive and record various information in memory regarding the one or more routines, the user, and/or the apparatus, such as pace, location, calories burned, amounts of resistance applied, time and/or distance intervals at particular amounts of resistance, and slope of the terrain. The processor 70 may also instruct the apparatus 10 to change the resistance by a particular amount during operation based on pre-programmed information, real-time data input by the user into the user interface 68, or external data received by the sensors 72, as depicted in step 208. For example, the processor 70 may instruct the apparatus 10 to change the resistance based on a wireless signal from a remote control device, such that a trainer or another observer may remotely increase or decrease the resistance of the apparatus 10. In another embodiment of the invention, the processor 70 may instruct the apparatus 10 to change the resistance at particular time intervals by particular amounts based on which user has approached the apparatus 10. This may be determined by sensors operable to detect RFID tags or similar identification devices. The apparatus 10 may, for example, be used for rehabilitation or therapeutic purposes, and information about a particular patient may be stored on an RFID tag, memory, or a portable electronic device.

The processor 70 may also determine various status data during operation of the apparatus 10 based on signals received from the sensors 72 and output the status data to the user interface 68, such as the display 78, as depicted in step 210. For example, the status data may comprise a user's pace, location, calories burned, distance to a goal, user biometric data, slope of the terrain, present amount of resistance, a percentage of body fat, an amount of power generated by the apparatus 10, and other information related to the user and/or the apparatus 10. Furthermore, the processor 70 may send data from its memory to an external device directly or wirelessly, as depicted in step 212, such that data from a particular user or a particular routine may be stored, reviewed, and/or analyzed elsewhere.

Although the invention has been described with reference to the embodiments illustrated in the attached drawing figures, it is noted that equivalents may be employed and substitutions made herein without departing from the scope of the invention as recited in the claims. For example, the electrical braking system 24 may be replaced with other braking systems. Specifically, the electrical braking system 24 may be replaced with any variable braking system or mechanical resistance providing devices, such as a mechanical gear box (not shown). In the mechanical gear box, a variety of different sized gears may be chosen to be rotatably coupled in order to change a gear ratio and therefore change an amount of resistance, in a manner similar to the gear system of a multi-speed bicycle. In another alternative embodiment of the invention, the electrical braking system 24 may be replaced with a friction providing apparatus (not shown) which may provide varying amounts of friction to at least one of the wheels 16-20, the wheel shaft 22, and/or another apparatus fixedly attached to the wheels 16-20 and/or the wheel shaft 22. In this embodiment, the greater the amount of physical pressure or friction provided, the greater amount of torque or effort will be required to rotate the wheels 16-20. The friction providing apparatus may be, for example, a caliper braking system or a roller resistance apparatus which applies a roller at various amounts of pressure to at least one of the wheels to create resistance. In another alternative embodiment of the invention, the electrical braking system 24 may be replaced with "eddy" brakes or electromagnetic brakes (not shown), which may use eddy currents to stop or slow motion without using friction.

Other systems that may be incorporated with or used as an alternative to the electrical braking system 24 may include: one or more hub motors; one or more disk brakes; a belt drive or direct drive of a hub motor/generator; air resistance from turbulent flow generated by fans; a step up pulley system to convert low speed to high rotations per minute, facilitating efficient generation of resistance using electrical methods; a variable pulley system producing a range of resistance, similar to a derailleur system's use of a chain drive, belt drive, toothed belt drive, and/or meshed gear system; a system comprising multiple motors to increase resistance; and/or hydraulic resistance.

Having thus described various embodiments of the invention, what is claimed as new and desired to be protected by Letters Patent includes the following:

1. An exercise apparatus configured to be pushed along a surface by a user, the apparatus comprising:

a frame having an upper portion and a lower portion;

a handle at the upper portion of the frame;

a wheel shaft rotatably supported by the frame;

a first wheel, a second wheel, and a third wheel, with the first and second wheels fixedly attached to the wheel shaft, wherein the first and second wheels are positioned rearward of the third wheel;

a generator braking system having a motor driven by rotation of the wheel shaft and having variable electrical resistance such that an amount of torque required to rotate the first and second wheels is dependent on the amount of electrical resistance provided to the motor; and uni-directional clutch bearings configured for coupling the wheel shaft with the generator braking system such that the motor is driven only when the first and second wheels are rotated forward and disengaged from the generator braking system when the first and second wheels rotate backwards.

2. The exercise apparatus of claim 1, wherein the generator braking system further comprises:

a series of gears rotatably dependent with each other, wherein at least one of the gears is fixedly attached to the wheel shaft;

a motor shaft fixedly connected to at least one of the gears such that a forward motion of the first wheel powers the motor; and a variable resistor electrically coupled with the motor and operable to provide the variable electrical resistance.

3. The exercise apparatus of claim 1, further comprising a user control panel operable to change the amount of electrical resistance provided to the generator braking system.

4. The exercise apparatus of claim 3, wherein the user control panel comprises a processor configured for changing an amount of the electrical resistance provided to the generator braking system based on at least one of data received via a user interface or sensor and pre-programmed control data stored in the processor.

5. The exercise apparatus of claim 1, wherein the upper portion of the frame is at least one of slidably and rotatably connected with the lower portion of the frame such that the portions of the frame may be configured in a first position for storage and reconfigured in a second position for operation.

6. The exercise apparatus of claim 3, wherein the control panel further comprises a sensor configured to receive a control signal from a remote device operable to change the amount of electrical resistance provided to the generator braking system.

7. The exercise apparatus of claim 4, wherein the processor is configured to change the amount of electrical resistance provided to the generator braking system based on biometric data received by the processor from a plurality of biometric sensors.

8. The exercise apparatus of claim 1, wherein the generator braking system provides electrical power to electronic devices attached thereto.

9. An exercise apparatus configured to be pushed along a surface by a user, the apparatus comprising:

a frame having an upper portion and a lower portion;

a handle at the upper portion of the frame;

a wheel shaft rotatably supported by the frame;

a first wheel, a second wheel, and a third wheel, with the first and second wheels fixedly attached to the wheel shaft;

wherein the first and second wheels are positioned rearward of the third wheel;

a series of gears rotatably dependent with each other, wherein at least one of the gears is fixedly attached to the wheel shaft;

a motor;

a motor shaft fixedly connected to at least one of the gears such that a forward motion of the first and second wheels powers the motor;

a variable resistor electrically coupled with the motor and operable to provide varying amounts of electrical resistance such that an amount of torque required to rotate the first and second wheels when the electrical resistance is small is greater than the amount of torque required to rotate the first and second wheels when the electrical resistance is large; and uni-directional clutch bearings configured for coupling the wheel shaft with the motor such that the motor is driven only when the first and second wheels are rotated forward and not when the first and second wheels rotate backwards.

10. The exercise apparatus of claim 9, further comprising a user control panel operable to change the amount of electrical resistance provided by the variable resistor.

11. The exercise apparatus of claim 9, further comprising one or more belts rotatably connecting two or more of the gears, wherein at least some of the series of gears have differing diameters such that a single rotation of the first wheel rotates the motor shaft a plurality of times.

12. The exercise apparatus of claim 10, wherein the user control panel comprises a processor configured for varying the amount of resistance provided by the variable resistor based on at least one of data received via a user interface or sensor and pre-programmed control data stored in the processor.

13. The exercise apparatus of claim 9, wherein the upper portion of the frame is at least one of slidably and rotatably connected with the lower portion of the frame such that the portions of the frame may be configured in a first position for storage and reconfigured in a second position for operation.

14. The exercise apparatus of claim 10, wherein the control panel further comprises a sensor configured to receive a control signal from a remote device operable to change the amount of electrical resistance provided by the variable resistor.

15. The exercise apparatus of claim 9, wherein the motor is configured to provide electrical power to electronic devices attached thereto.

16. An exercise apparatus configured to be pushed along a surface by a user, the apparatus comprising:

a frame having an upper portion and a lower portion;

a handle at the upper portion of the frame;

a wheel shaft rotatably supported by the frame;

a first wheel, a second wheel, and a third wheel, with the first and second wheels fixedly attached to the wheel shaft, wherein the first and second wheels are positioned rearward of the third wheel;

a variable braking system, driven by rotation of the wheel shaft, configured to provide varying amounts of resistance to rotation of at least one of the wheels;

a control panel configured to vary the amount of resistance provided to the first and second wheels and operable to receive a wireless signal and to vary the amount of resistance based on the wireless signal; and uni-directional clutch bearings configured for coupling the wheel shaft with the variable braking system such that the varying amounts of resistance are provided to the wheels only when the first and second wheels are rotated forward and not provided when the first and second wheels rotate backwards.

17. An exercise apparatus configured to be pushed along a surface by a user, the apparatus comprising:

a frame having an upper portion and a lower portion;

a handle at the upper portion of the frame;

a wheel shaft rotatably supported by the frame;

a first wheel, a second wheel, and a third wheel, with the first and second wheels fixedly attached to the wheel shaft, wherein the first and second wheels are positioned rearward of the third wheel;

a variable braking system, driven by rotation of the wheel shaft, configured to provide varying amounts of resistance to rotation of at least one of the wheels;

a control panel configured to vary the amount of resistance provided to the first and second wheels and operable to receive biometric data corresponding to a user from biometric sensors and to vary the amount of resistance based on the biometric data; and uni-directional clutch bearings configured for coupling the wheel shaft with the variable braking system such that the varying amounts of resistance are provided to the wheels only when the first and second wheels are rotated forward and not provided when the first and second wheels rotate backwards.

* * * * *